US012490872B2

(12) United States Patent
Jaco

(10) Patent No.: US 12,490,872 B2
(45) Date of Patent: Dec. 9, 2025

(54) ROTATABLE TOILET PAPER HOLDING ASSEMBLY

(71) Applicant: Desmond Jaco, Brookshire, TX (US)

(72) Inventor: Desmond Jaco, Brookshire, TX (US)

( * ) Notice: Subject to any disclaimer, the term of this patent is extended or adjusted under 35 U.S.C. 154(b) by 546 days.

(21) Appl. No.: 17/893,942

(22) Filed: Aug. 23, 2022

(65) Prior Publication Data

US 2024/0065493 A1 Feb. 29, 2024

(51) Int. Cl.
*A47K 10/38* (2006.01)
*A47K 10/32* (2006.01)

(52) U.S. Cl.
CPC ..... *A47K 10/38* (2013.01); *A47K 2010/3233* (2013.01)

(58) Field of Classification Search
CPC ..... A47K 10/32; B65H 16/06; B65H 16/04; B65H 49/32; E05C 19/063; E05C 19/06; E05C 3/00; G05G 1/02; G05G 1/005; G05G 1/08; H01H 25/06
USPC ..... 242/598, 598.2; 74/556
See application file for complete search history.

(56) References Cited

U.S. PATENT DOCUMENTS 4,241,885 A 12/1980 Robinson
5,690,302 A 11/1997 Batts
5,891,010 A * 4/1999 Kobben ..... B31D 5/0047 493/464
6,079,401 A * 6/2000 Alvord ..... H01H 3/20 200/18
7,306,185 B1 12/2007 Miller
7,360,739 B1 4/2008 Horvat
10,398,263 B2 9/2019 Goodman
10,905,293 B2 2/2021 Cohen
11,083,347 B2 8/2021 Hahn
11,937,742 B2 * 3/2024 Brazelton ..... A47K 10/3836
2021/0307568 A1 10/2021 Steinle

FOREIGN PATENT DOCUMENTS

WO WO20212021168 10/2021

* cited by examiner

*Primary Examiner* — Anna M Momper
*Assistant Examiner* — Tiffany Domonique Jefferson

(57) ABSTRACT

A rotatable toilet paper holding assembly includes a rotation mount that is mountable to a vertical support surface. The rotation mount has a rotation element that is rotatably disposed in the rotation mount. The rotation element is releasably locked in a first position or a second position. The rotation element includes a toilet paper mount for releasably engaging a roll of toilet paper. The toilet paper mount flips the roll of toilet paper when the rotation element is rotated between the first position and the second position. In this way the rotation element facilitates the roll of toilet paper to dispense toilet paper in a user's preferred orientation.

12 Claims, 3 Drawing Sheets

ROTATABLE TOILET PAPER HOLDING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to rotatable holding devices and more particularly pertains to a new rotatable holding device for holding a roll of toilet paper in one of two orientations. The device includes a rotation mount that is attachable to a vertical support surface and a rotation element that is rotatably disposed in the rotation mount. A toilet paper mount is attached to the rotation element such that the toilet paper mount is rotatable between first position and a second position. A roll of toilet paper is positionable on the toilet paper mount thereby facilitating the roll of toilet paper to be flipped to dispense toilet paper from a front of the roll of toilet paper or from a back of the roll of toilet paper.

(2) Description of Related Art Including Information Disclosed Under 37 CFR 1.97 and 1.98

The prior art relates to rotatable holding devices including a toilet paper holder that includes a mount and a holder rotatably disposed on the mount and finger holes in the holder to accommodate a user's fingers to rotate the holder. The prior art discloses a toilet paper holder that includes a mount, a stem that is rotatably attached to the mount and a toilet paper holder attached to the stem. The prior art discloses a toilet paper holder that includes a clamp, a flexible rod attached to the clamp and a spindle rotatably attached to the flexible rod. The prior art discloses a toilet paper holder that includes a wall mount that has a protruding lobe and a toilet paper holder pivotally attached to the protruding lobe. The prior art discloses a toilet paper holder that includes a mounting cup and a toilet paper holder that rotatably engages the mounting cup.

BRIEF SUMMARY OF THE INVENTION

An embodiment of the disclosure meets the needs presented above by generally comprising a rotation mount that is mountable to a vertical support surface. The rotation mount has a rotation element that is rotatably disposed in the rotation mount. The rotation element is releasably locked in a first position or a second position. The rotation element includes a toilet paper mount for releasably engaging a roll of toilet paper. The toilet paper mount flips the roll of toilet paper when the rotation element is rotated between the first position and the second position. In this way the rotation element facilitates the roll of toilet paper to dispense toilet paper in a user's preferred orientation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 4 is a top view of an embodiment of the disclosure.

FIG. 5 is a perspective in-use view of an embodiment of the disclosure.

DETAILED DESCRIPTION OF THE INVENTION

Figure 1:
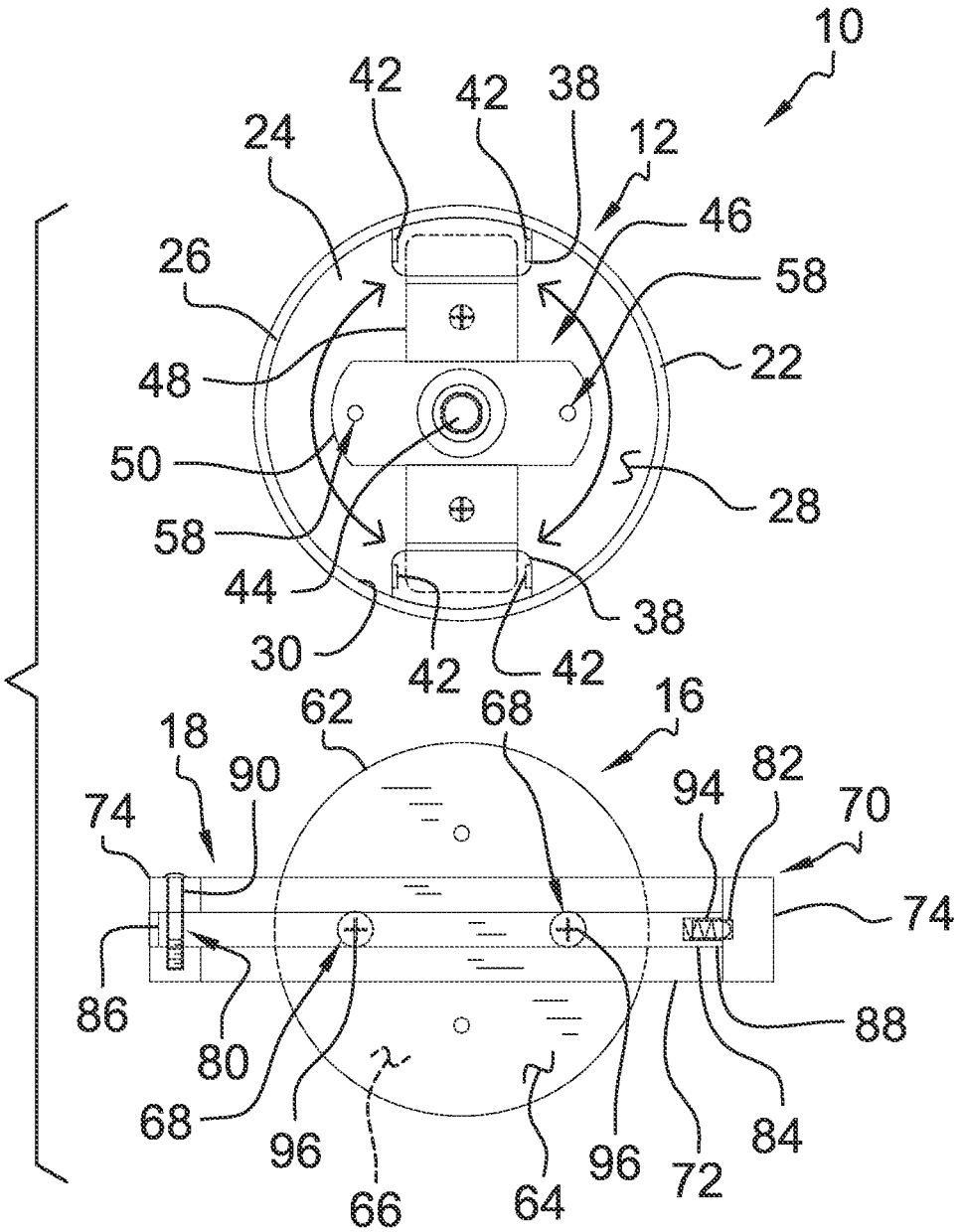
FIG. 1 is a front exploded view of a rotatable toilet paper holding assembly according to an embodiment of the disclosure.
Figure 2:
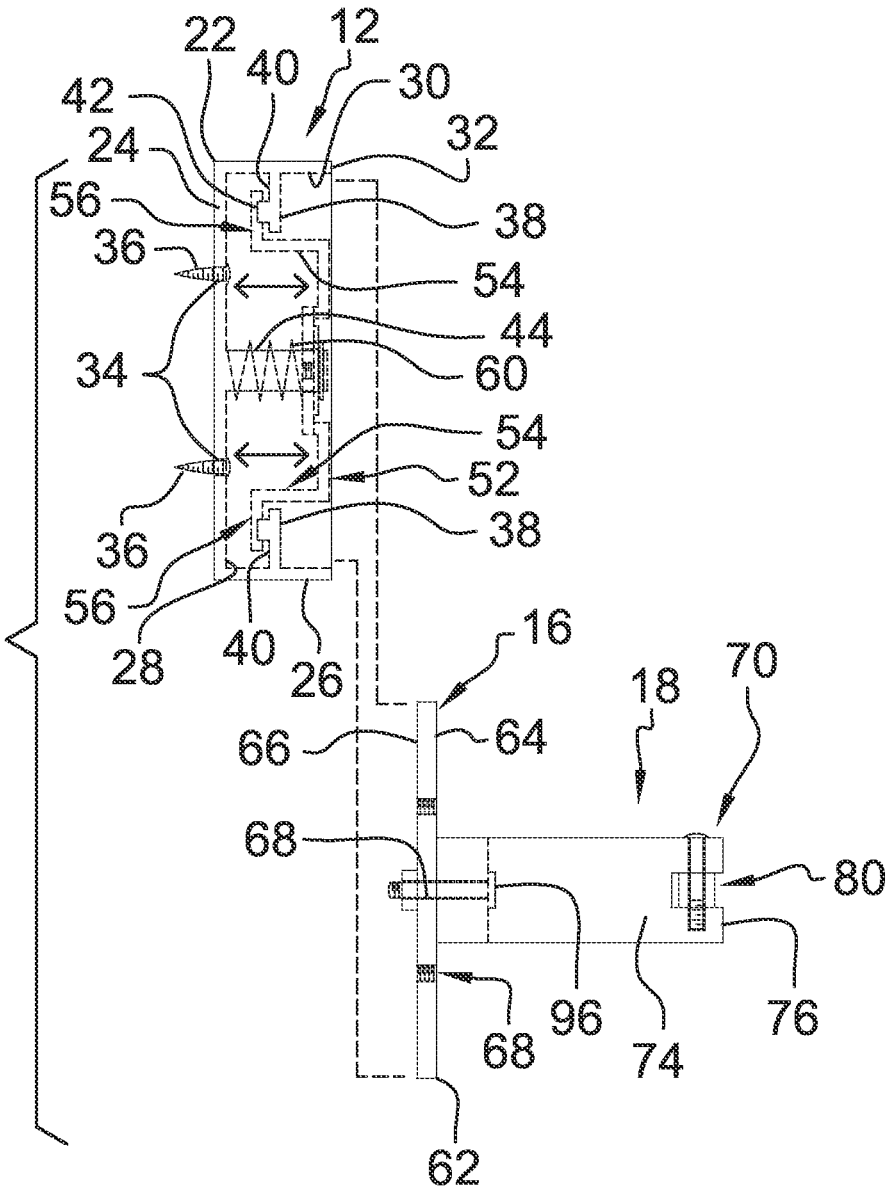
FIG. 2 is a right side phantom exploded view of an embodiment of the disclosure.
Figure 3:
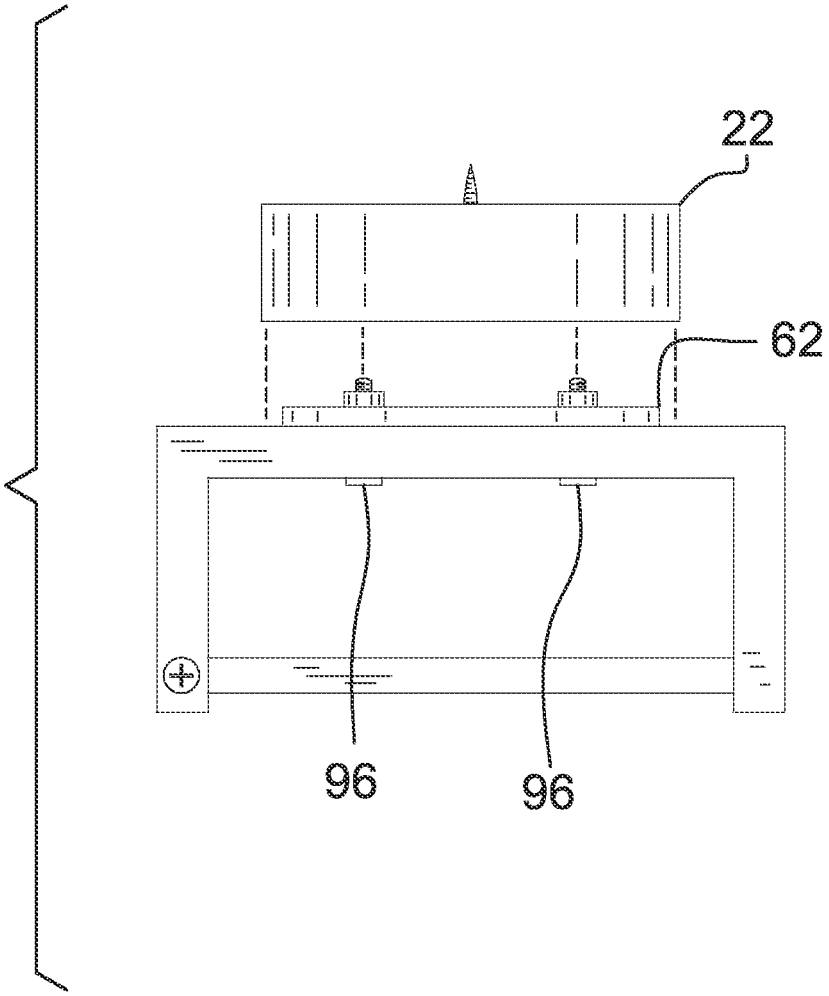
FIG. 3 is a top exploded view of an embodiment of the disclosure.

With reference now to the drawings, and in particular to FIGS. 1 through 5 thereof, a new rotatable holding device embodying the principles and concepts of an embodiment of the disclosure and generally designated by the reference numeral 10 will be described.

As best illustrated in FIGS. 1 through 5, the rotatable toilet paper holding assembly 10 generally comprises a rotation mount 12 that is mountable to a vertical support surface 14 and the rotation mount 12 has a rotation element 16 that is rotatably disposed in the rotation mount 12. The rotation element 16 is releasably locked in a first position or a second position. Furthermore, the rotation element 16 is rotatable between the first position and the second position when the rotation element 16 is urged into an unlocked condition. The rotation element 16 is biased into a locking condition for retaining the rotation element 16 in either the first position or the second position. Additionally, the rotation element 16 includes a toilet paper mount 18 for releasably engaging a roll of toilet paper 20. The toilet paper mount 18 flips the roll of toilet paper when the rotation element 16 is rotated between the first position and the second position. In this way the rotation element 16 facilitates the roll of toilet paper 20 to dispense toilet paper either in front of the roll of the roll of toilet paper 20 or behind the roll of toilet paper 20 in accordance with a user's preferred orientation.

The rotation mount 12 comprises a cup 22 that has a rear wall 24 and a perimeter wall 26 extending away from the rear wall 24. The rear wall 24 has a forward surface 28 and the perimeter wall 26 has an interior surface 30 and a distal edge 32 with respect to the forward surface 28. The rear wall 24 has a pair of mounting holes 34 each extending through the rear wall 24 thereby facilitating a pair of fasteners 36 to extend through a respective mounting hole 34 and engage the vertical support surface 14 for retaining the cup 22 on the vertical support surface 14. The vertical support surface 14 may be a wall in a bathroom, for example, or other location where toilet paper would be commonly employed.

The rotation mount 12 includes a pair of tabs 38 that is each positioned on the interior surface 30 of the perimeter wall 26 and each of the tabs 38 extends away from the interior surface 30 of the perimeter wall 26. Each of the tabs 38 is positioned between the distal edge 32 of the perimeter wall 26 and the forward surface 28 of the rear wall 24 and the tabs 38 are positioned on opposite sides of the perimeter wall 26 from each other. Each of the tabs 38 has a bottom surface 40 and the bottom surface 40 each of the tabs 38 has a pair of engagements 42 each extending toward the forward surface 28 of the rear wall 24. Additionally, the engagements 42 on each of the tabs 38 are spaced apart from each other.

The rotation mount 12 includes a peg 44 which extends away from the forward surface 28 of the rear wall 24 and the peg 44 is centrally positioned on the rear wall 24. The rotation mount 12 includes a bracket 46 that has a first member 48 which intersects a second member 50 at a perpendicular angle such that the bracket 46 forms a plus shape. The first member 48 has a central portion 52 is perpendicularly oriented with a pair of medial portions 54 and a pair of end portions 56 that are each perpendicularly oriented with a respective one of the medial portions 54. Each of the end portions 56 lies on a plane that is oriented parallel with the central portion 52.

The second member 50 has a pair of fastener apertures 58 each extending through the second member 50. The peg 44 extends through the central portion 52 of the bracket at a point that is centrally located between the pair of medial portions 54 such that the bracket 46 is rotatable on the peg 44. Furthermore, each of the medial portions 54 is directed toward the rear wall 24 of the cup 22 and each of the end portions 56 is directed toward the perimeter wall 26 of the cup 22. Each of the end portions 56 passes beneath a respective one of the tabs 38 when the bracket 46 is rotated.

The rotation mount 12 includes a biasing member 60 that is positioned around the peg 44. The biasing member 60 extends between the central portion 52 of the bracket 46 and the rear wall 24 of the cup 22 and the biasing member 60 biases the bracket 46 away from the rear wall 24. Each of the end portions 56 of the bracket 46 lies against a respective tab 38 having the end portions 56 being restrained between the pair of engagements 42 on the respective tab 38 when the end portions 56 are positioned beneath the respective tabs 38 and the bracket 46 is biased away from the rear wall 24. Each of the end portions 56 is restrained between the engagements 42 on a respective one of the tabs 38 when the rotation element 16 is in the first position. Conversely, each of the end portions 56 is restrained between the engagements 42 on an opposite one of the tabs 38 with respect to the first position when the rotation element 16 is rotated into the second position. Each of the end portions 56 is displaced from the respective tabs 38 and the associated engagements 42 when the bracket 46 is urged toward the rear wall 24 thereby facilitating the bracket 46 to be freely rotated.

The rotation element 16 comprises a disk 62 that has a first surface 64 and a second surface 66. The disk 62 has a pair of fastener apertures 68 each extending through the first surface 64 and the second surface 66. The second surface 66 of the disk 62 rests against the central portion 52 of the bracket 46 such that each of the fastener apertures 68 in the disk 62 is aligned with a respective one of the fastener apertures 58 in the central portion 52 of the bracket 46.

The toilet paper mount 18 comprises a yoke 70 that has a central member 72 extending between a pair of end members 74 and each of the end members 74 is perpendicularly oriented with the central member 72 such that the yoke has a U-shape. The central member 72 rests against the first surface 64 of the disk 62 such that each of the end members 74 is directed away from the disk 62 having the central member 72 oriented to extend along a line bisecting the disk 62. Additionally, the central member 72 has a length that is greater than a diameter of the disk 62 such that each of the end members 74 is spaced outwardly from disk 62.

Each of the end members 74 has a distal end 76 with respect to the central member 72 and a primary surface 78, and the primary surface 78 of each of the end members 74 is directed toward each other. A respective one of the end members 74 has a slot 80 extending from the distal end 76 of the respective end member 74 toward the central member 72. A respective one of the end members 74 has a recess 82 that is integrated into the primary surface 78 of the respective end member. The recess 82 is positioned adjacent to the distal end 76 of the respective end member. The toilet paper mount 18 includes a bar 84 that has a first end 86 and a second end 88 and the first end 86 is positioned in the slot 80 in the distal end 76 of a respective one of the end members 74.

The toilet paper mount 18 includes a pin 90 extending through a respective one of the end members 74 and extending through the bar 84 such that the bar 84 is hingedly attached to the respective end member 74. The bar 84 is positionable in an open position having the second end 88 being displaced from a respective one of the end members 74 thereby facilitating the bar 84 to be extended through a tube 92 of the roll of toilet paper 20. Conversely, the bar 84 is positionable in a closed position having the bar 84 extending between the pair of end members 74.

The toilet paper mount 18 includes a latch 94 that is movably integrated into the second end 88 of the bar 84 and the latch 94 is biased to extend outwardly from the second end 88. The latch 94 engages the recess 82 in the respective end member 74 when the bar 84 is positioned in the closed position for releasably retaining the bar 84 in the closed position. The toilet paper mount 18 includes a pair of fasteners 96 that each of the fasteners 96 extends through the central member 72 of the yoke. Each of the fasteners 96 extends through a respective fastener aperture 68 in the disk 62 and a respective fastener aperture 58 in the central portion 52 of the bracket 46 for attaching the yoke to the disk 62 and attaching the disk 62 to the bracket 46. The fasteners 96 associated with the toilet paper mount 18 may comprise a screw, a bolt or other type of threaded fastener.

In use, the rotation mount 12 is attached to the vertical support surface 14 in a strategic location in a bathroom and the roll of toilet paper 20 is placed on the toilet paper mount 18. The toilet paper mount 18 is pushed inwardly on the rotation mount 12 to facilitate the rotation element 16 to be rotated into either the first position or the second position. In this way the roll of toilet paper 20 can be flipped over to facilitate the roll of toilet paper 20 to dispense toilet paper from the front of the roll of toilet paper 20 from behind the roll of toilet paper 20. Thus, the roll of toilet paper 20 does not have to be removed from the toilet paper mount 18, as is commonly required with traditional toilet paper holders, in order to position the roll of toilet paper 20 in the preferred orientation. In this way the roll of toilet paper 20 is inhibited from being dropped and being exposed to water on the floor of the bathroom when a user wishes to change the orientation of the roll of toilet paper 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rotatable toilet paper holding assembly comprising:

a rotation mount being mountable to a vertical support surface, said rotation mount having a rotation element being rotatably disposed in said rotation mount and rotatable relative to the vertical support surface, said rotation element configured to be fixed in a first position or a second position and adapted to be displaced from said first position or said second position, said rotation element being rotatable between said first position and said second position when said rotation element is moved into an unlocked condition, said rotation element being biased into a locking condition for retaining said rotation element in either said first position or said second position, said rotation element including a toilet paper mount configured to retain a roll of toilet paper and adapted for the removal of said roll of toilet paper, said toilet paper mount rotating the roll of toilet paper perpendicular to an axis of rotation for dispensing toilet paper from said roll of toilet paper when said rotation element is rotated between said first position and said second position wherein said rotation element is configured to facilitate the roll of toilet paper to dispense toilet paper in one of a plurality of orientations; and wherein said rotation mount comprises:

a cup having a rear wall and a perimeter wall extending away from said rear wall, said rear wall having a forward surface, said perimeter wall having an interior surface and a distal edge with respect to said forward surface, said rear wall having a pair of mounting holes each extending through said rear wall thereby facilitating a pair of fasteners to extend through a respective mounting hole and engaging the vertical support surface for retaining said cup on the vertical support surface; and a pair of tabs, each of said tabs being positioned on said interior surface of said perimeter wall, each of said tabs extending away from said interior surface of said perimeter wall, each of said tabs being positioned between said distal edge of said perimeter wall and said forward surface of said rear wall, said tabs being positioned on opposite sides of said perimeter wall from each other, each of said tabs having a bottom surface, said bottom surface each of said tabs having a pair of engagements each extending toward said forward surface of said rear wall, said engagements on each of said tabs being spaced apart from each other.

2. The assembly according to claim 1, wherein said rotation mount includes a peg extending away from said forward surface of said rear wall, said peg being centrally positioned on said rear wall.

3. The assembly according to claim 2, wherein:

said rotation mount includes a bracket having a first member intersecting a second member at a perpendicular angle such that said bracket forms a plus shape, said first member having a central portion being perpendicularly oriented with a pair of medial portions and a pair of end portions being perpendicularly oriented with a respective one of said medial portions, each of said end portions lying on a plane being oriented parallel with said central portion, said second member having a pair of fastener apertures each extending through said second member; and said peg extends through said central portion of said bracket at a point being centrally located between said pair of medial portions such that said bracket is rotatable on said peg having each of said medial portions being directed toward said rear wall of said cup and having each of said end portions being directed toward said perimeter wall of said cup, each of said end portions passing beneath a respective one of said tabs when said bracket is rotated.

4. The assembly according to claim 3, wherein:

said rotation mount includes a biasing member being positioned around said peg, said biasing member extending between said central portion of said bracket and said rear wall of said cup, said biasing member biasing said bracket away from said rear wall; and each of said end portions of said bracket lies against a respective tab and having said end portions being restrained between said pair of engagements on said respective tab when said end portions are positioned beneath said respective tabs and said bracket is biased away from said rear wall.

5. The assembly according to claim 4, wherein each of said end portions is restrained between said engagements on a respective one of said tabs when said rotation element is in said first position, each of said end portions being restrained between said engagements on an opposite one of said tabs with respect to said first position when said rotation element is rotated into said second position.

6. The assembly according to claim 3, wherein said rotation element comprises a disk having a first surface and a second surface, said disk having a pair of fastener apertures each extending through said first surface and said second surface, said second surface of said disk resting against said central portion of said bracket such that each of said fastener apertures in said disk is aligned with a respective one of said fastener apertures in said central portion of said bracket.

7. The assembly according to claim 6, wherein said toilet paper mount comprises a yoke having a central member extending between a pair of end members, each of said end members being perpendicularly oriented with said central member such that said yoke has a U-shape, said central member resting against said first surface of said disk such that each of said end members is directed away from said disk, said central member being oriented to extend along a line bisecting said disk, said central member having a length being greater than a diameter of said disk such that each of said end members is spaced outwardly from disk.

8. The assembly according to claim 7, wherein each of said end members has a distal end with respect to said central member and a primary surface, said primary surface of each of said end members being directed toward each other, a respective one of said end members having a slot extending from said distal end of said end member toward said central member, a respective one of said end members having a recess being integrated into said primary surface of said respective end member, said recess being positioned adjacent to said distal end of said respective end member.

9. The assembly according to claim 8, wherein said toilet paper mount includes a bar having a first end and a second end, said first end being positioned in said slot in said distal end of a respective one of said end members; and a pin extending through a respective one of said end members and extending through said bar such that said bar is hingedly attached to said respective end member, said bar being positionable in an open position having said second end being displaced from a respective one of said end members thereby facilitating said bar to be extended through a tube of the roll of toilet paper, said bar being positionable in a closed position having said bar extending between said pair of end members.

10. The assembly according to claim 9, wherein said toilet paper mount includes a latch being movable into said second end of said bar, said latch being biased to extend outwardly from said second end, said latch engaging said recess in said respective end member when said bar is positioned in said closed position for releasably retaining said bar in said closed position.

11. The assembly according to claim 7, wherein said toilet paper mount includes a pair of fasteners, each of said fasteners extending through said central member of said yoke, each of said fasteners extending through a respective fastener aperture in said disk and a respective fastener aperture in said central portion of said bracket for attaching said yoke to said disk and attaching said disk to said bracket.

12. A rotatable toilet paper holding assembly comprising:

a rotation mount being mountable to a vertical support surface, said rotation mount having a rotation element being rotatably disposed in said rotation mount, said rotation element being releasably locked in a first position or a second position, said rotation element being rotatable between said first position and said second position when said rotation element is moved into an unlocked condition, said rotation element being biased into a locking condition for retaining said rotation element in either said first position or said second position, said rotation element including a toilet paper mount configured to retain a roll of toilet paper and adapted for the removal of said roll of toilet paper, said toilet paper mount rotating the roll of toilet paper perpendicular to an axis of rotation for dispensing toilet paper from said roll of toilet paper when said rotation element is rotated between said first position and said second position wherein said rotation element is configured to facilitate the roll of toilet paper to dispense toilet paper in one of a plurality of orientations, said rotation mount comprising:

a cup having a rear wall and a perimeter wall extending away from said rear wall, said rear wall having a forward surface, said perimeter wall having an interior surface and a distal edge with respect to said forward surface, said rear wall having a pair of mounting holes each extending through said rear wall thereby facilitating a pair of fasteners to extend through a respective mounting hole and engaging the vertical support surface for retaining said cup on the vertical support surface;

a pair of tabs, each of said tabs being positioned on said interior surface of said perimeter wall, each of said tabs extending away from said interior surface of said perimeter wall, each of said tabs being positioned between said distal edge of said perimeter wall and said forward surface of said rear wall, said tabs being positioned on opposite sides of said perimeter wall from each other, each of said tabs having a bottom surface, said bottom surface each of said tabs having a pair of engagements each extending toward said forward surface of said rear wall, said engagements on each of said tabs being spaced apart from each other;

a peg extending away from said forward surface of said rear wall, said peg being centrally positioned on said rear wall;

a bracket having a first member intersecting a second member at a perpendicular angle such that said bracket forms a plus shape, said first member having a central portion being perpendicularly oriented with a pair of medial portions and a pair of end portions being perpendicularly oriented with a respective one of said medial portions, each of said end portions lying on a plane being oriented parallel with said central portion, said second member having a pair of fastener apertures each extending through said second member, said peg extending through said central portion of said bracket at a point being centrally located between said pair of medial portions such that said bracket is rotatable on said peg having each of said medial portions being directed toward said rear wall of said cup and having each of said end portions being directed toward said perimeter wall of said cup, each of said end portions passing beneath a respective one of said tabs when said bracket is rotated; and a biasing member being positioned around said peg, said biasing member extending between said central portion of said bracket and said rear wall of said cup, said biasing member biasing said bracket away from said rear wall, each of said end portions of said bracket lying against a respective tab and having said end portions being restrained between said pair of engagements on said respective tab when said end portions are positioned beneath said respective tabs and said bracket is biased away from said rear wall, each of said end portions being restrained between said engagements on a respective one of said tabs when said rotation element is in said first position, each of said end portions being restrained between said engagements on an opposite one of said tabs with respect to said first position when said rotation element is rotated into said second position; and said rotation element comprising a disk having a first surface and a second surface, said disk having a pair of fastener apertures each extending through said first surface and said second surface, said second surface of said disk resting against said central portion of said bracket such that each of said fastener apertures in said disk is aligned with a respective one of said fastener apertures in said central portion of said bracket;

said toilet paper mount comprising:

a yoke having a central member extending between a pair of end members, each of said end members being perpendicularly oriented with said central member such that said yoke has a U-shape, said central member resting against said first surface of said disk such that each of said end members is directed away from said disk, said central member being oriented to extend along a line bisecting said disk, said central member having a length being greater than a diameter of said disk such that each of said end members is spaced outwardly from disk, each of said end members having a distal end with respect to said central member and a primary surface, said primary surface of each of said end members being directed toward each other, a respective one of said end members having a slot extending from said distal end of said end member toward said central member, a respective one of said end members having a recess being integrated into said primary surface of said respective end member, said recess being positioned adjacent to said distal end of said respective end member;

a bar having a first end and a second end, said first end being positioned in said slot in said distal end of a respective one of said end members;

a pin extending through a respective one of said end members and extending through said bar such that said bar is hingedly attached to said respective end member, said bar being positionable in an open position having said second end being displaced from a respective one of said end members thereby facilitating said bar to be extended through a tube of the roll of toilet paper, said bar being positionable in a closed position having said bar extending between said pair of end members;

a latch being movable into said second end of said bar, said latch being biased to extend outwardly from said second end, said latch engaging said recess in said respective end member when said bar is positioned in said closed position for releasably retaining said bar in said closed position; and a pair of fasteners, each of said fasteners extending through said central member of said yoke, each of said fasteners extending through a respective fastener aperture in said disk and a respective fastener aperture in said central portion of said bracket for attaching said yoke to said disk and attaching said disk to said bracket.

* * * * *